United States Patent [19]

Kato et al.

[11] 4,136,624

[45] Jan. 30, 1979

[54] INCINERATOR FOR REFUSE IN CONTAINERS AND METHOD OF INCINERATION THEREFOR

[75] Inventors: Nobuhide Kato, Niihama; Ryo Yasuno; Susumu Yajima, both of Fujieda, all of Japan

[73] Assignees: Sumitomo Durez Co., Ltd, Tokyo; Kabushiki Kaisha Niihama Tekkojo, Ehimeken, both of Japan

[21] Appl. No.: 813,472

[22] Filed: Jul. 7, 1977

[30] Foreign Application Priority Data

Jul. 12, 1976 [JP] Japan ..... 51-81950

[51] Int. Cl.[2] ..... F23G 7/00

[52] U.S. Cl. ..... 110/236; 134/19; 432/153; 432/236

[58] Field of Search ..... 110/236; 134/19, 1; 98/40 N; 432/9, 11, 72, 234, 236, 237, 153, 162, 182

[56] References Cited

U.S. PATENT DOCUMENTS

| | | | |
|---|---|---|---|
| 1,992,467 | 2/1935 | Blythe | 432/236 |
| 2,195,112 | 3/1940 | Klausner | 432/9 |
| 2,325,023 | 7/1943 | Allred | 98/40 N |
| 3,163,134 | 12/1964 | Stratford | 432/11 |
| 3,647,194 | 3/1972 | Brungraber et al. | 432/234 |
| 3,726,204 | 4/1973 | Lindestrom | 98/40 N |
| 3,749,602 | 7/1973 | Mosier | 134/19 |
| 3,778,221 | 12/1973 | Bloom | 432/1 1 |
| 3,839,086 | 10/1974 | Larson | 134/19 |
| 4,021,192 | 5/1977 | Ferguson et al. | 432/72 |
| 4,033,715 | 7/1977 | Beck | 432/153 |

*Primary Examiner*—Henry C. Yuen

*Attorney, Agent, or Firm*—Ira Milton Jones & Associates

[57] ABSTRACT

An incinerator is provided with water cooled nozzles for blowing pressure air into refuse in open-topped containers, fuel burners for heating the containers from the outside, a water cooled grate and doors at the inlet and outlet of the incinerator. The containers are mounted on receiver dishes, delivered in sequence into the incinerator. Refuse is incinerated by blowing pressure air from the nozzles down into each container while heating the container at its sides. Emptied containers can be reused.

4 Claims, 8 Drawing Figures

INCINERATOR FOR REFUSE IN CONTAINERS AND METHOD OF INCINERATION THEREFOR

This invention relates to an incinerator for refuse in containers such as drums, and to a method of effecting perfect incineration of the refuse to permit the reuse of the containers.

In the petroleum chemical industry large quantities of refuse are produced, often in the form of sludgy, high viscosity liquid-like materials, solidified powders or lumps. Since most such refuse is put in non-inflammable receptacles, it has been desired to dispose of the refuse as it is held in the container.

Also refuse from factories, such as residues produced in cleaning liquid chemical tanks, sewage treatment tanks or pits and dust collected in sweeping floors is in most cases being put in containers such as drums that become objects to be disposed of. Yet there is no other way to dispose of them then by incineration.

It is utterly impossible to effect incineration of refuse in containers in existing incinerators.

One reason is that when one is to incinerate refuse in a container in the conventional incinerator, it is necessary to maintain a high temperature therein for a long time, yet because of want of air in the container, gas only is produced in the surface of the refuse and the refuse becomes carbonized without combusting. Since the carbonization impedes heat conduction and contact with air, material in the central portion of the container is left unburned. Therefore it is the usual practice in the disposal of refuse in containers as such that firstly the refuse, together with the container, is heated to reduce the viscosity of the container contents and make it burn by spraying fuel thereover; or the refuse is taken out by cutting the container and after mixing it with saw dust or the like, it is thrown again into the incinerator, Yet since such refuse is of high viscosity and in a lump, it cannot be burned completely because of insufficient contact with air and as a result it is reduced only to a large amount of cinders.

It is often very difficult to take refuse out of the container and the container once cut can not be reused. Though some of the containers may be reused, it is necessary to give them chemical or physical treatment, such as water washing or burning because some refuse still remains attached in the interior of the container.

To avoid these problems, it is most desirable if possible to completely burn the refuse while it is in the container.

In view of the above, the object of the present invention is to furnish an improved incinerator and method of incineration whereby a full supply of air is maintained in the container for complete combustion and to make possible the reuse of the container.

To achieve the above, the incinerator of the present invention is provided with nozzles for blowing pressure air onto refuse packed into an open-topped container, burners for heating the outside of the container, a grate consisting of water cooled pipes on which the container is moved and doors at the inlet and outlet of the incinerator. Accordingly the method of incineration involves blowing pressure air onto the refuse in the container from nozzles placed above the corresponding container, while heating the container from the outside with burners.

Now the present invention is described in detail with reference to the accompanying drawings.

Figure 1:
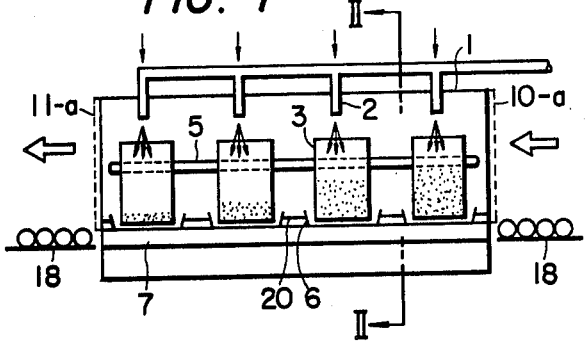
FIG. 1 is a longitudinal section view of an incinerator of the present invention with water pipes used as a grate.
Figure 2:
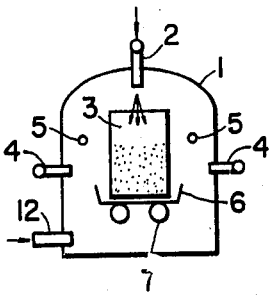
FIG. 2 is a section view taken on line II-II of FIG. 1.

In FIGS. 1 and 2, the whole incinerator furnace is surrounded by refractory walls which define a combustion chamber 1 that has at its ceiling nozzles 2 from which pressure air is blown into containers 3 such as open-topped drums. Just above each container, one or more such nozzles are positioned. The nozzles 2 can be water cooled to prevent them from being burned.

Also each nozzle 2 can have one or more blowing ports which are so shaped that pressure air is blown either in a straight or a vortex stream. Furthermore, each nozzle 2 is either fixed to the combustion chamber or is made rotatable so that primary air can be blown appropriately or is adjustable to move up and down to enable primary air to be blown directly into a container beneath it. Burners 4 are positioned at one or both side walls of the combustion chamber 1 so that flame from them can directly contact the containers. Thus with fuel and primary air blowing, combustion and heating can be effected.

Further, water cooling pipes 5 are preferably provided on the side walls to confine the containers to straight-line motion in the furnace. Containers 3 mounted on receiver dishes or trays 6 are moved horizontally on the incinerator grate 7.

The tray-like receiver dish 6 is provided so that molten burning or unburned refuse that is flushed out of the container by pressure air and overflows into the receiver dish can burn completely therein without contaminating the grate 7 and the bottom of the incinerator furnace.

All receiver dishes 6 are sized identically. The burners 4 and nozzles 2 are so positioned that flame can directly strike the containers 3. Also it is possible to connect adjacent receiver dishes 6, 6 with a connection ring 20 for their correct positioning. Further, it is preferable to provide an additional member at the bottom of the receiver dish so that the receiver dish is held against-shifting laterally.

The grate 7 can consist either of water cooled pipes or of rotatable rollers or the like.

Figure 3:
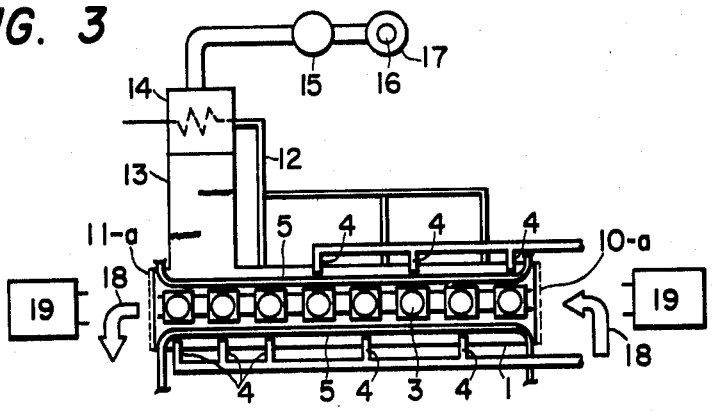
FIG. 3 is a plan view of the incinerator of FIG. 1.
Figure 4:
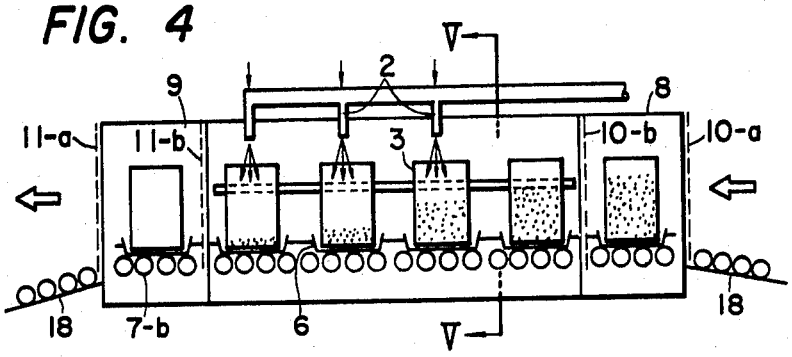
FIG. 4 is a longitudinal view of the incinerator using rotatable rollers as a grate.
Figure 5:
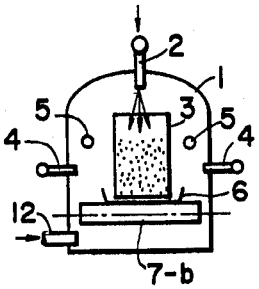
FIG. 5 is a section view taken on line V-V in FIG. 4.
Figure 6:
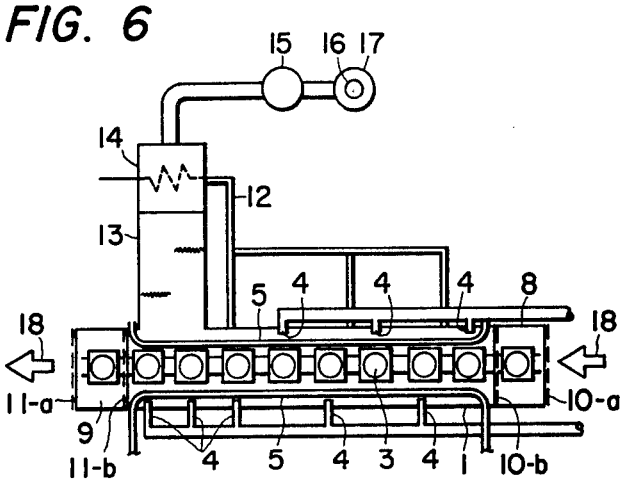
FIG. 6 is a plan view of the incinerator of FIG. 4.
Figure 7:
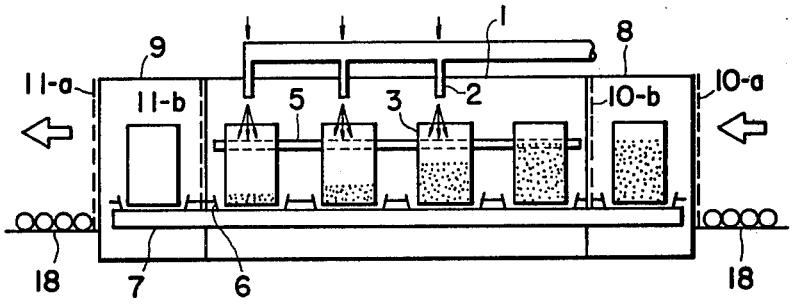
FIG. 7 is a longitudinal section view of the incinerator with water pipes as a grate and provided with two pairs of doors.

When water pipes are used as grate 7 they are made of steel or stainless steel or the like and, extending in the direction of advance of the containers and located at the appropriate height from the incinerator floor. The interior of each pipe is water cooled so that it is prevented from burning out at high temperature. As shown in FIG. 3, a driving means 19 for moving receiver dishes fore and back is provided at the outside of incinerator and is operated either automatically or manually. The incinerator is provided with doors, each having a cut-out at its bottom to accommodate a connection ring 7. When the grate 7 is formed of a series of rotatable water cool rollers as seen in FIGS. 4–6, each roller 7-b is provided with rotary joints at the sides and its interior is water cooled. These rollers can be rotated in synchronism either automatically or manually. Such rotatable rollers 7b are disposed at proper height from the incinerator floor with an appropriate gap between adjacent rollers. Since the bottoms of containers are heated with combustion gas counterflowing on the floor and passing through the gaps between the rotating adjacent rollers, or with preheated secondary gas, combustion effect is very high as in the case of water pipes. At the inlet and outlet of the incinerator 1, either a pair of doors (FIG. 1) or two pairs of doors (FIGS. 4 and 7) may be provided. The doors (**10-*a*, 10-*b*, 11-*a*, 11-*b*) are made of metal and/or refractory material and are arranged to be moved edgewise vertically or horizontally. Preferably each door is made of refractory material reinforced with steel so that it will have more insulative effect for heat and will be low in cost and rigid. Particularly if airtight chambers 8, 9 are constructed with two pairs of doors 10-*a*, 10-*b*, 11-*a*, 11-*b*, so that each chamber is airtight from the outside and from the combustion chamber, there will not be any disturbance of combustion caused by flickering of flame due to air blown in from the outside. Accordingly when a container 3 is taken in or out, refuse in the containers still in the furnace may be continually incinerated without suspending the blowing of pressure air. Each airtight chamber has a capacity to house one or several containers 3**.

As to whether single doors or two pairs doors shall be adopted, this may be properly determined depending on the variety of refuse or its volume to be put in. From the view point of continual incineration of refuse in the container, the two pairs of doors will be preferable.

In FIGS. 2 and 3, a secondary air pipe 12 is provided on the wall of the combustion chamber 1. From this pipe, air necessary for complete combustion is supplied in the incinerator. By using air preheated by a heat exchanger 14, combustion effect is increased and fuel can be saved.

It is preferable to maintain a temperature of 600–900° at the time of combustion in the incinerator. Gas from the combustion chamber 1 flows into a secondary combustion chamber 13 at the side of the furnace where it effects perfect combustion into smokeless and odorless gas and whereby produced heat is delivered to the heat exchanger 14 and its surroundings. Thereafter the gas is guided by an induction fan 15 into a chimney 16 and through a wet type dust collector 17, it is exhausted therefrom to the outside.

In the secondary combustion chamber 13, for effecting perfect combustion, of gas the temperature is kept at 800–1000°. For this, a fuel burner and air pipe are provided. Its wall is formed of fire proof bricks.

Operation of the incinerator of the present invention is as follows. In FIGS. 4–6, one or several top open containers containing refuse are put on the receiver dishes 6. After the front door is opened, the rotatable rollers or dish moving means are driven to deliver the containers into the combustion chamber 1. Then the door is closed.

Each container 3 is correctly positioned to have its center just beneath the corresponding nozzle 2 and the fire flame from fuel burner 4 directed to strike the container. Thus all the containers 3 are moved by operation of water cooled rollers or by the dish driver 19.

Next after the induction fan 15 and wet type dust collector 17 are in operation the fuel burner in the secondary combustion chamber 13 is ignited so as to raise the temperature therein. When ignited, blazingly blowing flame is allowed to strike the wall of container 3 directly to heat it, thereby the temperature in the combustion chamber 1 is raised. In this instance, secondary air from the secondary air pipe 12 is naturally introduced to assist combustion. As the temperature of the container 3 rises, refuse begins turning into gas and when it reaches the ignition temperature, it begins burning.

After the volatile part of the refuse has burned (for burning it, it requires 30–120 minutes), pressure air is blown from the nozzles into the container to effect perfect combustion of the refuse. Since a facility is provided to control the volume, the pressure and the blowing time of air in accordance with the quality and quantity of the refuse, an optimum supply is maintained. Preferably the pressure of the air is higher than 0.5 $kg/cm^2G$ and more preferably is 0.5–7 $kg/cm^2G$. If pressure air were lower than 0.5 $kg/cm^2G$, it would not be effective as it would be overcome by the furious flame produced by combustion of the refuse. On the other hand, if the pressure air were higher than 7 $kg/cm^2G$, it would also not be effective as the refuse in the container would burst out. The total amount of blown-in air is 0.1–0.5 $m^3$/minute for one container. In case pressure air has been preheated with the heat exchanger, the consumption of fuel is effectively reduced. Containers 3 which were moved by the rollers or by dish moving means and have been subjected to combustion are then brought out of the furnace.

The dish circulating means 18 is located outside the furnace and dishes and containers taken out from the combustion chamber are taken off of and delivered onto the conveyor at the outside of the incinerator.

The conveyor is constructed to circulate dishes to the entrance of the incinerator by manual or automatic driving means. Containers are collected from the conveyor and put again on the receiver dish, filled with refuse.

Also the receiver dish circulating means 18 is effective for the saving of combustion.

By repeating the procedures as above, refuse can be burned intermittently or continually in a very effective and safe manner. For ex. by providing a control instrument for opening and closing doors, starting and turning off fire, blowing of pressure air, operation of nozzles and moving of receiver dishes (rotatable rollers or dish moving means), the operation of these can be coordinated. If circumstances allow, a part of these means may be operated manually.

Further for putting the present invention in better practice, the use of two pairs of doors is recommended. In this case, one or more open-topped containers 3 filled with refuse are put on the receiver dishes 6. After the door **10-*a* is opened, these are caused to travel by rotatable rollers or receiver dish moving means into the airtight chamber. Then the door 10-*a* is closed and another door 10-*b* is opened and then after the containers 3 are put into the furnace by means of the rotatable rollers or dish moving means 19, the door 10-*b*** is closed. Also taking out the containers can similarly be done by opening and closing the respective doors. Hence, when a system having two pairs of doors is used, containers can be easily moved into and out of the furnace without admitting substantial amounts of outside air into it, to enable continual incineration of refuse in the containers without stopping supply of fuel from the burners and pressure air from the nozzles.

The present invention is further explained by the following specific embodiments. However it is to be noted the present invention is by no means limitted thereto.

Embodiment 1

An incinerator with water pipes as its grate, as shown in FIG. 3, was used and refuse was incinerated.

Refuse: Sludge containing dry paints
Container: Iron drums
Contents: 150 kg per drum (Top cut open).

Firstly 10 drums on receiver dishes were put in combustion chamber 1 and the door closed. Next, the fuel burner 4 was fired and the volatile components in the refuse were burned. After this working for 50 minutes (sometimes burner was put off), air pressure at 7 $kg/cm^2G$, air volume of 0.4 $m^3$/minute (per nozzle) was blown in from nozzle 2. In 6 hours the refuse was perfectly incinerated. Result of the incineration is as follows:

No. 3 heavy oil 60 liters per hour
Temperature in furnace: 800°–900° C.
Exhausted gas: Temp. 200° C. 4000 $m^2/H$
Smoke dust: 0.2 $g/m^3$ Sulfur 0.5 $m^3/H$.

After burning, there was only a small amount of carbonized material left (this can be buried) in two of the drums. Others were completely empty. Drums were reused.

Embodiment 2

An incinerator as shown in FIG. 6 was used. Refuse was incinerated with rotatable water cooled rollers as the grate.

Refuse: paste state or solid thermosetting resin
Container: iron drums
Contents: 140 kg/drum (Top cut open).

Firstly receiver dishes were positioned along the full length of the incinerator and drums with refuse were mounted on the dishes. After the door **10-*a* was opened, rotatable water cooled rollers were driven and drums with refuse were moved into the airtight chamber 8 and the door 10-*a* was closed. The doors 10-*b* and 11-*b* were opened and drums were moved into the combustion chamber. After one receiver dish was moved into airtight chamber 9, doors 10-*b*, 11-*b* were closed. Then the door 11-*a* was opened and one receiver dish was taken out of the airtight chamber 9 and moved on receiver dish circulating means 18. After the dish had been taken out, door 11-*a*** was closed. Then the fuel burner was fired, and the volatile components in the refuse were burned.

After this working for 50 minutes, a sequence control means comprising a timer limit switch in combination with a brake motor actuated the two pairs of doors and the rotatable water cooled rollers to move the drums. The first drum was moved by its dish to be established directly under a nozzle for blowing pressure air. From the pressure air nozzle, air of pressure 5 $kg/cm^2G$, volume of 0.3 $m^2$/minute (per nozzle) was blown. In this instance, flame from the fuel burner was set to directly strike the drum.

Repeating the above procedures, incineration of refuse was made. When the number of drums gradually increased to the full capacity of the incinerator, all pressure air nozzles and fuel burners worked with full capacity, yet in this case, the fuel burners nearest the inlet and outlet were sometimes put off, and 8 drums were always in the incinerator. Result of continual incineration for 5 days was as follows.

Disposal of drums with refuse: 120 drums (average 24 drums a day)
Disposed volume of refuse: 16,800 kg (average 3,360 kg a day)
Fuel consumed (average): No. 3 heavy oil 40 liters per hour
Temperature in furnace: 700°–900° C.

No black smoke was produced during the time of incineration and almost no carbonated material was left in the drums after incineration, and drums were in condition to be reused. The incinerator and method of incineration of the present invention were proved to be very safe. The continuous and economical operation and saving were achieved.

Embodiment 3

Figure 8:
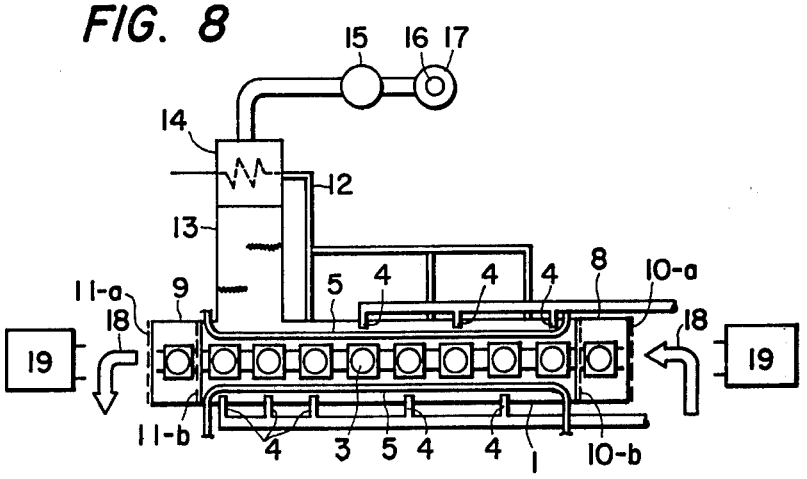
FIG. 8 is a plan view of the incinerator of FIG. 7.

An incinerator with water flow pipes as a grate, as shown in FIG. 8, was used. Refuse was incinerated as in Embodiment 2. Doors **10*a*, 10*b*, 11-*a*, 11-*b*, each having an appropriate cut-out portion, were utilized. Motion was imparted to each receiver dish by dish moving means 19** placed at the inlet. There was no trouble in opening and closing of the doors.

The dish moving means 19 at the inlet was so made that circulated dishes were pushed from behind from the inlet to the airtight chamber 8 and thence into the furnace. A dish moving means 19 at the outlet was so made that when the dishes were moved to the outside of the incinerator, such dishes were pulled forward by this moving means.

By virtue of the shape of the doors and the dish moving means 19, movement of dishes was carried out very smoothly. Thus the incineration of refuse was effected continuously as in Embodiment 2. The incinerator and method of incineration of the present invention were proved to be very safe and thus continuous and economical operation were achieved.

What is claimed is:

1. Apparatus by which refuse in an open-topped container can be completely incinerated without being removed from the container, said apparatus comprising:

A. a receiver dish upon which the container can rest with its open top uppermost, said receiver dish being large enough to have marginal portions that extend beyond a container thereon for receiving material that falls down alongside the container;

B. means defining a closed incineration chamber having at least one door through which the receiver dish with a container thereon can be moved into and out of the incineration chamber;

C. liquid cooled supporting means in the interior of the incineration chamber upon which a receiver dish having a container thereon can rest and upon which the receiver dish is readily movable horizontally;

D. burner means in said chamber comprising fuel nozzle means located and arranged to guide burning fuel substantially laterally against the side of a container in the chamber;

E. means for blowing air downwardly into the open top of a container in the incineration chamber, the last mentioned means comprising
(1) a downwardly opening air nozzle in an upper portion of the incineration chamber interior; and
(2) means for forcing air through said nozzle at a rate to cause a substantial stream of air to be projected downwardly therefrom;

F. said incineration chamber has a length to contain a substantially aligned plurality of receiver dishes, each with a container thereon, further characterized by:
(1) said burner means comprising a plurality of fuel nozzles spaced from one another along the length of the chamber;
(2) a plurality of air nozzles spaced from one another along the length of the chamber, and
(3) said chamber having doors at both ends thereof to permit receiver dishes and the containers they carry to move through the chamber in one direction, entering the chamber at one end thereof and leaving it at its other end;

G. means linking a plurality of receiver dishes with one another, chain-fashion, and means for advancing the linked receiver dishes stepwise into, through and out of the incineration chamber; and H. said liquid cooled supporting means comprises liquid cooled pipes fixed in substantially closely spaced relation and in a common horizontal plane, upon which receiver dishes can slide.

2. The apparatus of claim 1, further characterized by: said doors being arranged in sets at the ends of the incineration chamber, with a set of doors at each end of said chamber arranged to define an air lock in which one receiver dish and a container thereon can be held, said air locks thus preventing substantial loss of heat from the interior of the incineration chamber as containers are moved into and out of the chamber.

3. The apparatus of claim 1 wherein said means for forcing air through said nozzle is constructed and arranged to impart to such air a pressure higher than 0.5 $kg/cm^2G$ and to propel such air at a rate on the order of 0.1 to 0.5 $m^3$ per minute.

4. Apparatus by which refuse in an open-topped container can be completely incinerated without being removed from the container, said apparatus comprising:

A. a receiver dish upon which the container can rest with its open top uppermost, said receiver dish being large enough to have marginal portions that extend beyond a container thereon for receiving material that falls down alongside the container;

B. means defining a closed incineration chamber having at least one door through which the receiver dish with a container thereon can be moved into and out of the incineration chamber;

C. liquid cooled supporting means in the interior of the incineration chamber upon which a receiver dish having a container thereon can rest and upon which the receiver dish is readily movable horizontally;

D. burner means in said chamber comprising fuel nozzle means located and arranged to guide burning fuel substantially laterally against the side of a container in the chamber;

E. means for blowing air downwardly into the open top of a container in the incineration chamber, the last mentioned means comprising
(1) a downwardly opening air nozzle in an upper portion of the incineration chamber interior; and
(2) means for forcing air through said nozzle at a rate to cause a substantial stream of air to be projected downwardly therefrom;

F. said incineration chamber has a length to contain a substantially aligned plurality of receiver dishes, each with a container thereon, further characterized by:
(1) said burner means comprising a plurality of fuel nozzles spaced from one another along the length of the chamber;
(2) a plurality of air nozzles spaced from one another along the length of the chamber, and
(3) said chamber having doors at both ends thereof to permit receiver dishes and the containers they carry to move through the chamber in one direction, entering the chamber at one end thereof and leaving it at its other end;

G. means linking a plurality of receiver dishes with one another, chain-fashion, and means for advancing the linked receiver dishes stepwise into, through and out of the incineration chamber; and H. said liquid cooled supporting means comprises liquid cooled rollers arranged parallel to one another, transversely to the length of the incinerator, and in a common horizontal plane, and upon which receiver dishes can ride as they are moved through the incineration chamber.

* * * * *